US005333594A

United States Patent [19]

Robinson

[11] Patent Number: 5,333,594

[45] Date of Patent: Aug. 2, 1994

[54] GUN WITH VARIABLE GAS POWER

[76] Inventor: Robert Robinson, 695 Blaine Way, Hayward, Calif. 94544

[21] Appl. No.: 105,381

[22] Filed: Aug. 12, 1993

[51] Int. Cl.[5] ..... F41B 11/00

[52] U.S. Cl. ..... 124/73; 124/71; 124/56

[58] Field of Search ..... 124/56, 70, 71, 72, 124/73, 74, 75, 76; 251/216, 215; 89/193

[56] References Cited

U.S. PATENT DOCUMENTS 2,357,951 9/1944 Hale ..... 124/72
4,616,622 10/1986 Milliman ..... 124/71
4,936,282 6/1990 Dobbins et al. .
5,063,905 11/1991 Farrell .
5,161,516 11/1992 Ekstrom .

*Primary Examiner*—Randolph A. Reese
*Assistant Examiner*—Anthony Knight
*Attorney, Agent, or Firm*—Schneck & McHugh

[57] ABSTRACT

A pneumatic gun containing a variable gas flow valve, adjustable in-situ within the gun for regulating air pressure into the barrel. The valve includes a body with a passageway through which gas flows and a screw which is rotated through an aperture or inspection hole in the gun itself to adjust the size of a gas flow passageway, thereby supplying a continuously variable amount of gas pressure to power a projectile, such as a paint ball, at a range of controlled velocities.

20 Claims, 3 Drawing Sheets

GUN WITH VARIABLE GAS POWER

Paint ball war games are usually played out of doors in a geographic area in which the participants can roam. In order to avoid injury, these war games often have an upper limit on the velocity with which the paint balls can be fired, typically 300 feet per second, the violation of which may disqualify a player. It is strategically advantageous, however, to fire the paint balls at, or very close to, that upper velocity, in order to more accurately and effectively fire upon opponents.

As the temperature of the atmosphere in the geographic area in which the war game is played varies, the velocity of the projectiles also varies. For example, a gun that is set to fire at 290 feet per second may, after a ten degree Fahrenheit increase in the ambient temperature, fire paint balls at 320 feet per second. To compensate for this variation, some gas powered paint ball war guns have a screw threaded into a tubular bolt through which the gas flows to power the paint balls, the screw extending into the tube a variable amount to vary the gas flow to the paint ball. This adjustment, however, can only change the velocity of the paint balls by about 10 feet per second.

Some guns also have multi-port plugs that can be rotated to position ports of varying size in the path of the gas that powers the projectiles, the flow of gas thereby regulated by the size of the port through which the gas passes. As the flow of gas changes so does the velocity of the paint balls propelled by that flow, and so these guns are able to provide a few discrete velocity adjustments. The multi-port plugs that can be rotated to vary the gas flow are held in place with a pair of set screws, so when the gas flow needs to be varied, these set screws must be completely removed from the gun, the plug rotated, and the set screws then screwed back in place while the plug is held in the new position. This adjustment also requires the gas supply to be disconnected from the gun.

Also, as these ports must be drilled in advance to compensate for small changes in velocity due to the changes in atmospheric conditions, the variations they provide in gas flow are small and limited in number. As such, these variations are not sufficient to compensate for large velocity changes, such as that needed to significantly alter the distance the projectile is to be fired.

It is therefore an object of the present invention to provide a means for adjusting the velocity of gas powered projectiles that is easy and quick to accomplish.

It is a further object of this invention that the means for adjusting the velocity of gas powered projectiles allows for adjustment over a large range of velocities.

It is yet another object of this invention that the means for adjusting the velocity offers a continuous range of velocities that can be selected, rather than a few discrete velocities.

DISCLOSURE OF THE INVENTION

The present invention accomplishes these objectives by providing a valve that can vary the flow of gas used to propel a projectile by a gas powered gun. This valve is made up of a valve body through which the gas flows and a screw which the gas must flow past to propel the projectile. The screw is seated in a threaded center of a slot in the valve body through which the gas flows, the gas passing opposite sides of the screw before exiting from the top of the slot into an orifice. When the screw is rotated and the top of the screw is moved closer to the orifice, the gas flow is restricted, lowering the velocity of the projectiles being fired. As the screw is rotated to move the top away from the orifice, the gas flows at a greater rate through the valve, and the velocity of the projectiles is increased.

The adjustment of the screw can be made from outside the gun with the aid of a small screw tool, such as a wrench or a knob. Due to the ease and quickness with which this adjustment can be made, fine tuning of the velocity of the projectiles to a desired speed is aided. The velocity of the projectiles can also be adjusted over a large range of speeds by rotating the screw completely in or out.

In one embodiment of this invention, the valve is positioned within a plug that can replace a corresponding plug in an existing gun. In such guns, access holes are available through which the adjustment of the valve by rotation of the screw can be performed. It may also be possible to modify such a gun that does not have an access hole by drilling such a hole.

In another embodiment of this invention, the valve is an integral part of a newly manufactured gun.

BEST MODE FOR CARRYING OUT THE INVENTION

Figure 1:
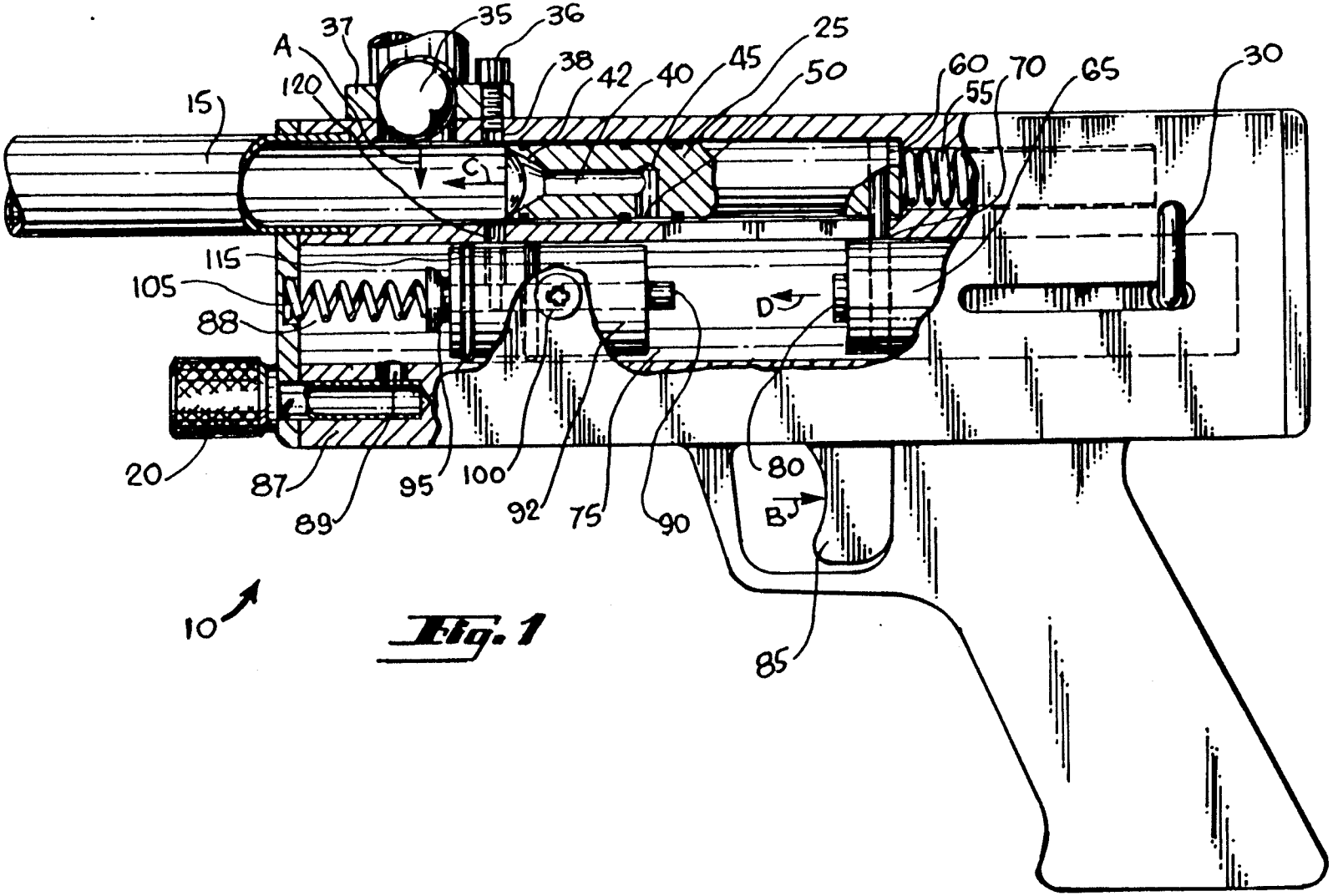
FIG. 1 is a side view of a preferred embodiment of the invention.

Referring now to FIG. 1, a gun 10 is shown having a projectile barrel 15 and a modular connection 20 for an external source of pressurized gas (not shown). A projectile bolt 25 which is slidably encased within the projectile barrel 15 is drawn back by a sliding grip 30 to a position which allows a unit of ammunition 35 from an ammunition supply (not shown) to drop into the projectile barrel 15, as indicated by arrow A. A screw 36 holds an ammunition supply platform 37 to the gun 10 by threading into a hole 38 in the projectile barrel 15. The projectile bolt 25 has an axial bore 40 in a front end 42 that allows a passage for gas to power the ammunition 35. The axial bore 40 is connected to a vertical bore 45 having an opening 50 on the bottom of the projectile bolt 25, which is covered by the projectile barrel 15 while the projectile bolt 25 is drawn back to be in position for receiving ammunition 35, as depicted in FIG. 1.

With the projectile bolt 25 drawn back as shown in FIG. 1, a first spring 55 abutted against a rear 60 of the projectile bolt 25 is compressed and is held in this compressed state by a catch (not shown). The projectile bolt 25 is rigidly connected to an actuator bolt 65 by means of a vertical member 70. The actuator bolt 65 is slidably encased within an actuator barrel 75. The actuator bolt 65 has an axial protrusion 80 on its front end.

The external source of pressurized gas (not shown) is in gas flow communication through the modular connection 20 with a first chamber 87 which is in gas flow communication with a second chamber 88 through an orifice 89.

When the catch is released by a rearward movement of a trigger 85, as indicated by arrow B, the bias of the first spring 55 forces both the projectile bolt 25 and the actuator bolt 65 rapidly forward, as indicated by arrows C and D. The protrusion 80 of the actuator bolt 65 contacts a valve stem 90 which protrudes from a plug 92 that is fixedly attached within the actuator barrel 75 by means of a pair of set screws 100 that screw into the plug 92 from both sides of the gun 10. The momentum of the bolts is sufficient to overcome the bias of a second spring 105 which presses on an annular valve 95 to which the valve stem 90 is rigidly connected.

Figure 2:
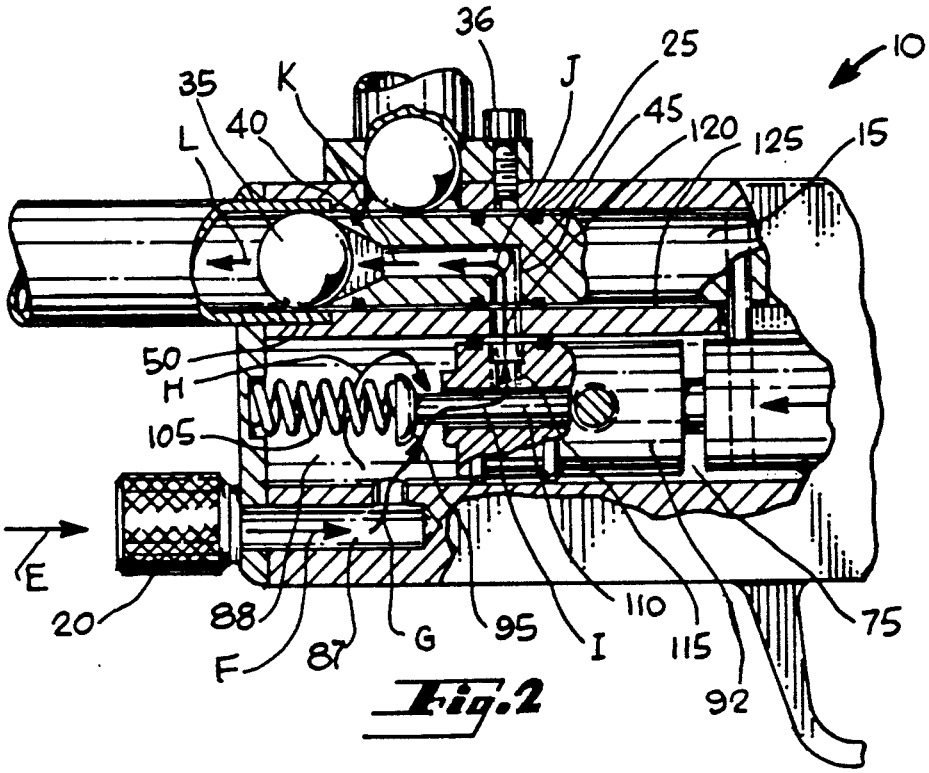
FIG. 2 is a side view of some elements of a preferred embodiment of the invention as it is fired.

Referring to FIG. 2, as the annular valve 95 is pushed from the plug, the pressurized gas flows from the second chamber 88 and into an axial port 110 in the plug 92. Arrow E depicts a flow of pressurized gas from an external supply (not shown) through the modular connection 20 and into first chamber 87. The gas then flows through first chamber 87, as shown by arrow F, and into second chamber 88, as shown by arrow G. Arrows G and H depict the flow of gas from second chamber 88 and into axial port 110. The axial port 110 is in gas flow communication with a vertical port 115, which is in gas flow communication with an orifice 120 in a wall 125 separating the actuator barrel 75 from the projectile barrel 15, and arrow I shows the flow of gas through these passageways. With the projectile bolt 25 in a forward position due to the bias of first spring 55, opening 50 in the projectile bolt 25 is aligned with orifice 120, allowing the pressurized gas to travel through vertical bore 45 and axial bore 40, as shown by arrows J and K, thereby providing the force to propel the ammunition 35 forward, as indicated by arrow L.

Figure 3:
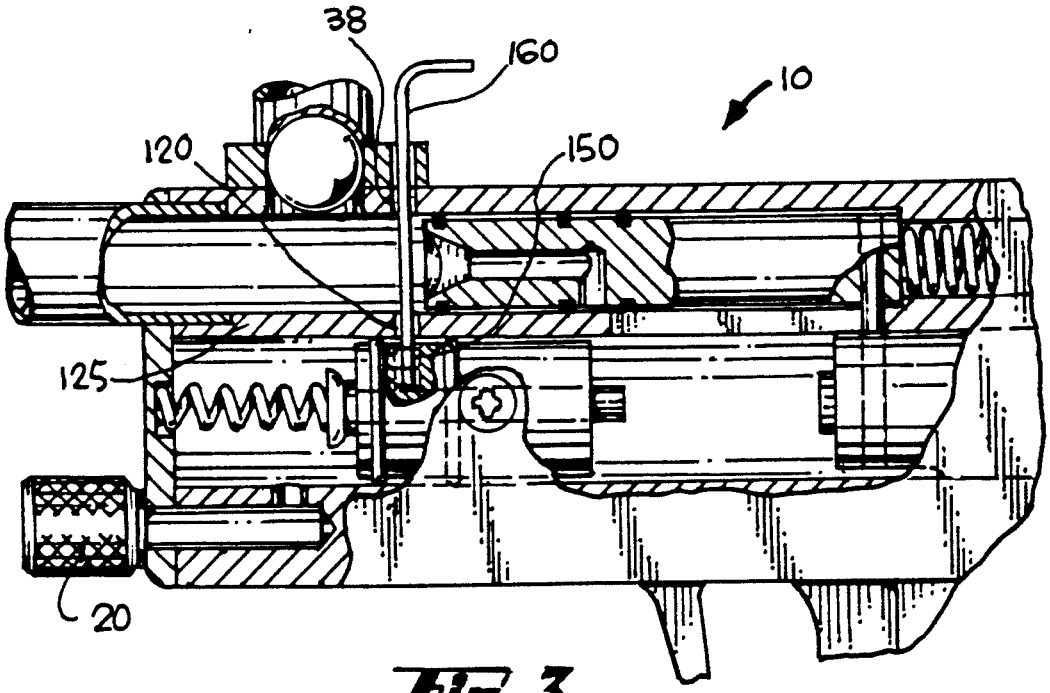
FIG. 3 is another side view of some elements of a preferred embodiment of the invention as the gas flow valve is adjusted.

FIG. 3 shows the gun 10 with the screw 36 removed to allow Allen wrench 160 to extend through hole 38 to adjust screw 150.

Figure 4:
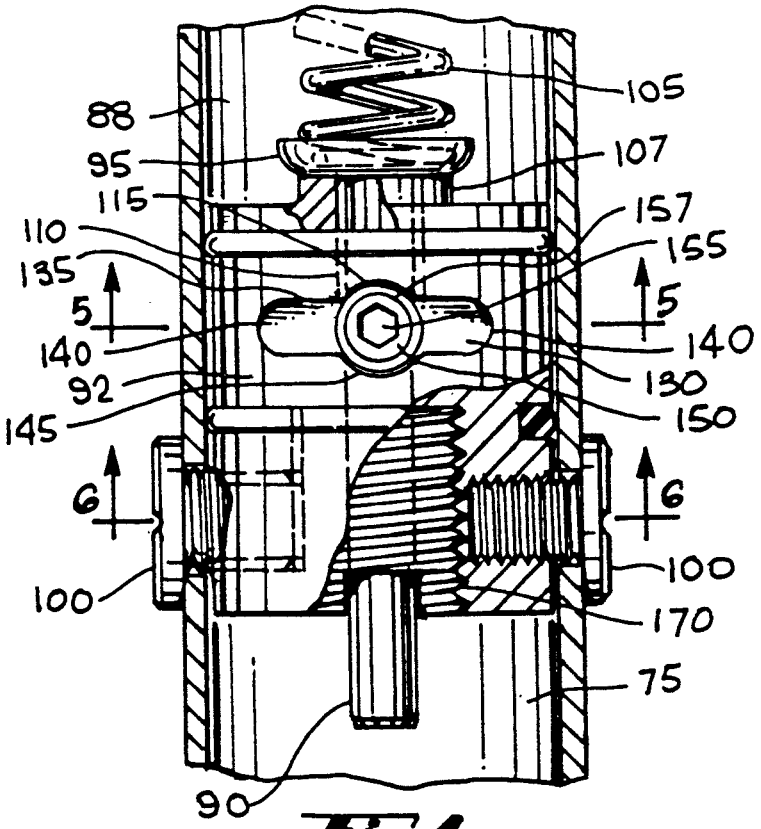
FIG. 4 is a top view of a preferred embodiment of the invention.

In FIG. 4 the set screws 100 are shown holding the plug 92 fixed within the actuator barrel 75. Also shown is the annular valve 95 pressed by the second spring 105 against an annular ridge 107 located at the front of the plug 92. The axial port 110 has a diameter larger than that of the valve stem 90 but less than that of the annular valve 95, thereby allowing gas to pass from the second chamber 88 through the axial port 110 only when the valve 95 is pushed away from the ridge 107 of the plug 92.

The vertical port 115 is shown to be comprised of a slot 130 having parallel end walls 135 and side walls 140 that extend upward from the axial port 110. A vertical, cylindrical aperture 145 having a diameter greater than the distance between the end walls 135 but less than the diameter of the axial port is tapped and a screw 150 is threaded into the aperture 145. The screw 150 shown has a hexagonally walled depression 155 at its top 157 to allow the screw to be rotated by a tool such as an Allen wrench 160, but it could easily have a top of a different shape to allow it to be rotated by a different tool, such as a screwdriver (see also FIG. 3).

Figure 5:
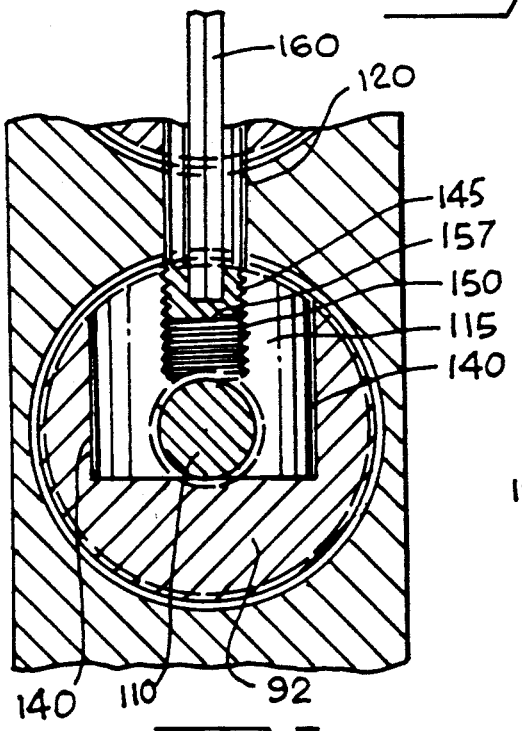
FIG. 5 is a cross-sectional view of an adjustable valve of a preferred embodiment of the invention.

Referring now to FIG. 5, a rear view cross sectional diagram of the vertical port 115 and related elements is shown. The cylindrical axial port 110 is shown at the center of the cylindrical plug 92. The screw 150 is shown within the tapped aperture 145 which is centrally located between the side walls 140 of the port 115. An Allen wrench 160 is shown protruding through the orifice 120 connecting the vertical port 115 with the projectile barrel 15 (see also FIG. 3). As the Allen wrench is used to rotate the screw 150 downward, the distance between the top 157 of the screw 150 and the orifice 120 is increased, allowing the pressurized gas to flow at a greater velocity through the orifice 120 to propel the ammunition 35 with greater velocity. Conversely, as the screw 150 is moved upward by rotation from the Allen wrench 160, the distance between the top 157 of the screw 150 and the orifice 120 is decreased, restricting the flow of gas through the orifice 120 and causing the ammunition 35 to be propelled at a lower velocity.

Figure 6:
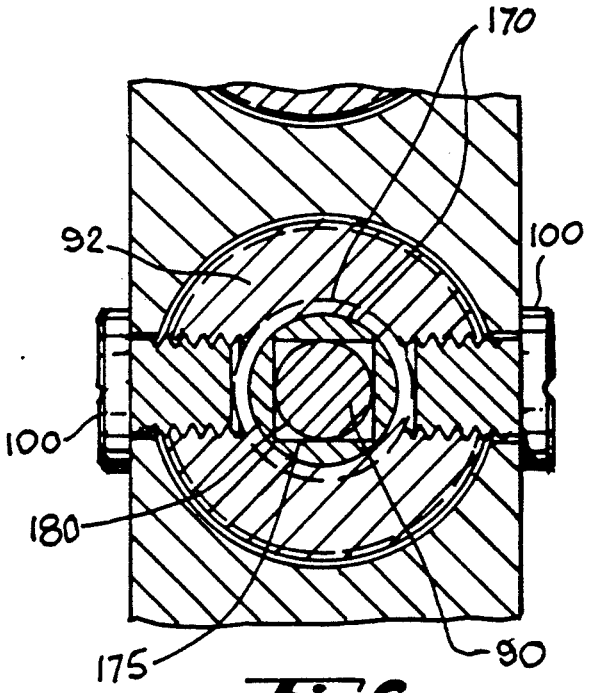
FIG. 6 is a cross-sectional view of the attachment of an adjustable valve of a preferred embodiment of the invention.

FIG. 6 shows a cross-sectional diagram of the set screws 100 and related elements. The cylindrical plug 92 has been axially bored and threaded at that point, and contains a threaded shaft 170 which is also shown in FIG. 4. The set screws 100 are threaded into the cylindrical plug 92 from both sides of the gun. The threaded shaft 170 has been axially bored with a rectangular opening 175 within which the valve stem 90 is slidably disposed. The gas passageways 180 provided by the corners of the rectangular openings 175 provide a gas flow that helps to urge the actuator bolt 65 (shown in FIGS. 1 and 2) back into a cocked position after the gun has fired. The passageways 180 also provide a release for gas that helps to avert an explosion.

It should be noted that the shape of the port and screw described above can be varied. For example, the screw 150 could restrict gas flow more as the screw 150 is moved closer to axial port 110. Alternatively, instead of the vertical port 115, a port could run diagonally through the plug 92 to connect the axial port 110 and the orifice 120. It should also be noted that the invention described herein is not limited to paint ball guns but can be used with any pneumatic gun, such as those used for firing pellets, darts, harpoons, etc.

What is claimed is:

1. A pneumatic gun comprising:

a projectile barrel with a gas-operated, reciprocating, tubular, ammunition-contacting bolt, the barrel having a transverse opening of a size accommodating a screw tool, an actuator barrel aligned parallel to the projectile barrel, the actuator barrel in gas flow communication with the projectile barrel through an orifice aligned with the opening, the actuator barrel holding a trigger responsive shuttle which discharges pressurized gas from the actuator barrel into the orifice and through the tubular bolt, the bolt having a bore in gas flow communication with the orifice, a variable gas flow valve disposed within the actuator barrel, the valve defining a gas flow passageway adjustable by a screw, the screw aligned with the orifice and the opening of the projectile barrel, the screw having a top which fits the screw tool, an external means for supplying pressurized gas to the actuator barrel, whereby gas pressure is adjusted in-situ by a screw tool turning the screw of the gas flow valve.

2. A gun as in claim 1 wherein the gas flow passageway is defined by the top of the screw and the orifice.

3. A gun as in claim 2 wherein the gas flow passageway is defined by a bottom of the screw and a port.

4. A gun as in claim 3 wherein gas flow passageway is defined by at least one side of the screw and a port.

5. A gun as in claim 2 wherein the port is a slot and the screw is threaded into a center of the slot, the gas flow passageway being further defined by a port and opposite sides of the screw.

6. A gun as in claim 2 wherein the gas flow passageway is smaller as the top of the screw is closer to the orifice, and the gas flow passageway is larger as the top of the screw is further from the orifice.

7. A gun as in claim 3 wherein the gas flow passageway is smaller as the bottom of the screw is closer to a bottom of the port, and the gas flow passageway is larger as the bottom of the screw is further from a bottom of the port.

8. A gun as in claim 6 wherein the gas flow passageway is always at least somewhat open.

9. A gun as in claim 7 wherein the gas flow passageway is always at least somewhat open.

10. A gas powered gun of the type having a projectile barrel with a reciprocating, tubular, ammunition-contacting bolt and having an external gas supply feeding into an actuator barrel aligned parallel to the projectile barrel, the actuator barrel in gas flow communication with the projectile barrel through an orifice, the actuator barrel holding a trigger responsive shuttle which discharges gas from the external supply to the orifice, the orifice in gas flow communication with a bore extending into the tubular bolt, the improvement comprising:

a variable gas flow valve disposed within the actuator barrel, the valve defining a gas flow passageway adjustable by a screw, the screw aligned with the orifice and with an opening in the projectile barrel opposite the orifice, whereby the gas flow through the valve may be increased or decreased in-situ as the screw is rotated by a tool inserted through the opening in the projectile barrel.

11. An improvement as in claim 10 wherein the gas flow passageway is defined by the top of the screw and the orifice.

12. An improvement as in claim 11 wherein the gas flow passageway is defined by a bottom of the screw and a port.

13. An improvement as in claim 12 wherein gas flow passageway is defined by at least one side of the screw and a port.

14. An improvement as in claim 13 wherein the port is a slot and the screw is threaded into a center of the slot, the gas flow passageway being further defined by a port and opposite sides of the screw.

15. An improvement as in claim 14 wherein the gas flow passageway is smaller as the top of the screw is closer to the orifice.

16. An improvement as in claim 15 wherein the gas flow passageway is always at least somewhat open.

17. An improvement as in claim 12 wherein the gas flow passageway is smaller as the bottom of the screw is closer to a bottom of the port.

18. An improvement as in claim 12 wherein the gas flow passageway is always at least somewhat open.

19. A gas powered gun of the type having a projectile barrel with a reciprocating, tubular, ammunition-contacting bolt and having a supply of pressurized gas feeding into an actuator barrel aligned parallel to the projectile barrel, the actuator barrel in gas flow communication with the projectile barrel through an orifice, the actuator barrel holding a trigger responsive shuttle which discharges pressurized gas from the supply to the orifice, the tubular bolt having a bore aligned with the orifice as the gas is discharged, the bolt drawn back from the orifice as the gun is cocked, the improvement comprising:

a variable gas flow valve in the actuator barrel defining a gas flow passageway adjustable by a screw, the screw aligned with the orifice and with an opening in the projectile barrel opposite the orifice, whereby the gas flow through the valve may be increased or decreased in-situ as the screw is rotated by a tool inserted through the opening in the projectile barrel.

20. An improvement as in claim 19 wherein the screw can be adjusted while the gun is cocked, whereby the gas is not discharged during the adjustment, nor is the pressurized supply of gas disconnected during the adjustment.

* * * * *

UNITED STATES PATENT AND TRADEMARK OFFICE

CERTIFICATE OF CORRECTION

PATENT NO. : 5,333,594

DATED : August 12, 1994

INVENTOR(S) : Robert Robinson

It is certified that error appears in the above-indentified patent and that said Letters Patent is hereby corrected as shown below:

Column 1, line 1, before the first paragraph insert

- - Technical Field

This invention relates to gas powered guns. More particularly, it relates to a means for adjusting the flow of gas powering such guns.

Background Art

Gas powered guns have long been known, and the factors that influence the velocity of a projectile fired from such a gun are also well known. For given dimensions of the bore firing the projectiles and a given projectile shape and mass, the velocity of the projectiles fired from such a gun will depend on the flow of gas powering the projectile, and also on the atmospheric conditions through which the projectile must travel.

The velocity of the projectile is important in many instances. To fire projectiles longer distances requires a greater velocity, yet that greater velocity may cause damage when fired at a closer range to the target. Thus it is often desirable to have a means for adjusting the velocity of the projectiles.

UNITED STATES PATENT AND TRADEMARK OFFICE

CERTIFICATE OF CORRECTION

PATENT NO. : 5,333,594

DATED : August 12, 1994

INVENTOR(S) : Robert Robinson

It is certified that error appears in the above-indentified patent and that said Letters Patent is hereby corrected as shown below:

Gas powered marking guns have been used for tagging animals for identification. Such guns employ paint balls for projectiles, the paint balls consisting essentially of spherical walls filled with paint, the paint balls rupturing upon striking a target and thereby marking it. Recently guns firing paint balls have been used in "war games" between human participants, wherein the paint balls mark the people that have been hit without causing them serious injury. Examples of such guns can be found in U.S. Pat. No. 4,936,282 to Dobbins et al., U.S. Pat. No. 5,063,905 to Farrel, U.S. Pat. No. 5,161,516 to Ekstrom and references cited therein. - -.

Signed and Sealed this

Twenty-seventh Day of September, 1994

*Attest:*

Bruce Lehman

BRUCE LEHMAN

*Attesting Officer*

*Commissioner of Patents and Trademarks*